US006302275B1

(12) United States Patent
Shuttleworth et al.

(10) Patent No.: US 6,302,275 B1
(45) Date of Patent: Oct. 16, 2001

(54) BELT TRACKING FOR MAGNETIC ROLL SEPARATOR

(75) Inventors: Timothy Guy Shuttleworth, Girard; David Scott Bard, Fairview; Richard Scott Darling, Erie, all of PA (US)

(73) Assignee: Erie E Magnetics, Erie, PA (US)

( * ) Notice: Subject to any disclaimer, the term of this patent is extended or adjusted under 35 U.S.C. 154(b) by 0 days.

(21) Appl. No.: 09/585,198

(22) Filed: Jun. 1, 2000

(51) Int. Cl.[7] ..... B03C 1/00

(52) U.S. Cl. ..... 209/219; 209/213; 209/217; 209/218; 209/221

(58) Field of Search ..... 209/213, 217, 209/218, 219, 221, 227, 228; 198/619

*Primary Examiner*—Donald P. Walsh
*Assistant Examiner*—Mark J. Beauchaine
(74) *Attorney, Agent, or Firm*—Richard K. Thomson

(57) ABSTRACT

A tracking system employs a strip of readily magnetizable material adhered to at least one edge of a conveyor belt used with a magnetic roll separator. The magnetic field produced by the head roller of the conveyor belt produces a continuous centering force which acts on the easily magnetized material providing proper tracking for the conveyor belt. The readily magnetizable material can be attached directly to either surface of the belt, have an edge portion of the belt wrapped around it or, in the form of a woven wire mesh, have the belt integrated into it by vulcanization. The strip of material may be continuous or intermittent.

20 Claims, 2 Drawing Sheets

BELT TRACKING FOR MAGNETIC ROLL SEPARATOR

BACKGROUND AND SUMMARY OF THE INVENTION

The present invention is directed to a device for facilitating tracking of an elastomeric belt used with a magnetic roll separator. More particularly, the present invention is directed to at least one thin strip of ferromagnetic or easily magnetizable material incorporated into an edge portion of the belt used in a magnetic roll separator, the magnetic field formed by the separator roll causing tracking of the belt.

Magnetic roll separators are used to remove ferromagnetic metals or para-magnetic materials from non-metals or from weakly magnetic material a) so that the commercially valuable fraction (usually the more strongly magnetic material) can be processed or, b) so that one fraction does not enter a machine or a process where such material could do damage to the machine or to the product being processed. Magnetic roll separators typically employ an elastomeric belt wrapped around two rollers, one of which, generally the head roller, is comprised of stacks of magnetic disks of rare-earth metals interposed with disk-shaped pole pieces. In use, material containing one or more magnetic components is dropped on the belt and the belt used to impel the non-magnetic material into a first collection bin on a trajectory determined only by the inertia of the material while the magnetic roller retains the more magnetic material in contact with the belt as long as the belt is in contact with the roller and drops it in a second bin, its trajectory being determined by the combination of its inertia and the force exerted by the magnetic field.

These belts pose a significant tracking problem for a number of reasons. First, the belts are very thin, typically between 2 and 20 mils, the thinner the better so as not to unduly abate the strength of the magnetic field operating on the material to be separated. Such paper thin belts can be easily shifted. An unbalanced load of material dropped onto the belt all too readily destabilizes the belt. Second, these belts have a very small length to width ratio. Such short, wide belts are difficult to guide. To further exacerbate the problem with the belts used in magnetic separators, the combination of thin belts and abrasive material results in rapid wear requiring frequent belt replacement. If the belt cannot be easily installed, tensioned, and stabilized, the system will have a large amount of costly down time. Further, belts that lose tracking easily are changed out more frequently since loss of tracking can result in damage to these thin belts. A belt which would track better would have extended wear life and require less frequent inspection to assure proper operation which, in turn, lowers manpower costs.

Traditional means of belt tracking are generally inappropriate in this application. Some belt trackers employ crowned pulleys or other means to shape the belt. In this application, it is essential that the head roller be as flat as possible in order to maximize the lateral distribution of the sortable material. Another technique involving mechanical engagement between the conveyor belt and the tracking roller, such as ribs on one and grooves on the other, produces accelerated wear in these thin belts, is generally not effective with short, wide belts, and the grooves are subject to filling by dust resulting in reduced effectiveness of the tracking technique and undesirable flexing of the belt adversely affecting load distribution. A third technique employs annular collars formed on the rollers to guide the belt back on track. These collars can be effective with thicker belts but in this application, produce accelerated wear of the edges and necessitate additional clearance around the pulleys which interferes with the separation operation.

The present invention overcomes these and other difficulties with traditional tracking systems. A thin strip of soft, magnetically susceptible material is incorporated in at least one of the belt edge portions. This soft magnetizable strip is subjected to the magnetic field created by the separator roller, the magnetic field having significant strength adjacent the outermost pole pieces, resulting in improved tracking of the belt. Any uneven loading causing a mechanical upset of the belt will quickly be overcome and the belt stabilized as a result of the magnetic attraction between the magnetically susceptible strip and the magnetic field created by the separator roller. This provides a persistent self-centering force which makes the belt easy to install, requires minimum head/tail roller adjustment, and provides extended belt life since there is no mechanical engagement with the belt which could produce accelerated wear. The strip of magnetically susceptible material can take any of a number of configurations and may be attached in any of a number of different manners. The ferrous material may be encased in a urethane elastomer, for example, the urethane sandwiching the edge of the belt. Alternatively, the urethane may partially encase the magnetizable material and be directly attached to the upper or lower face of the belt adjacent one or both edges. The magnetizable material may take the form of a cable and have the edge of the belt wrapped there around and secured by adhesive, or the like. Alternatively, the magnetizable material may take the form of a woven wire mesh which is incorporated into the edge portion of the belt.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
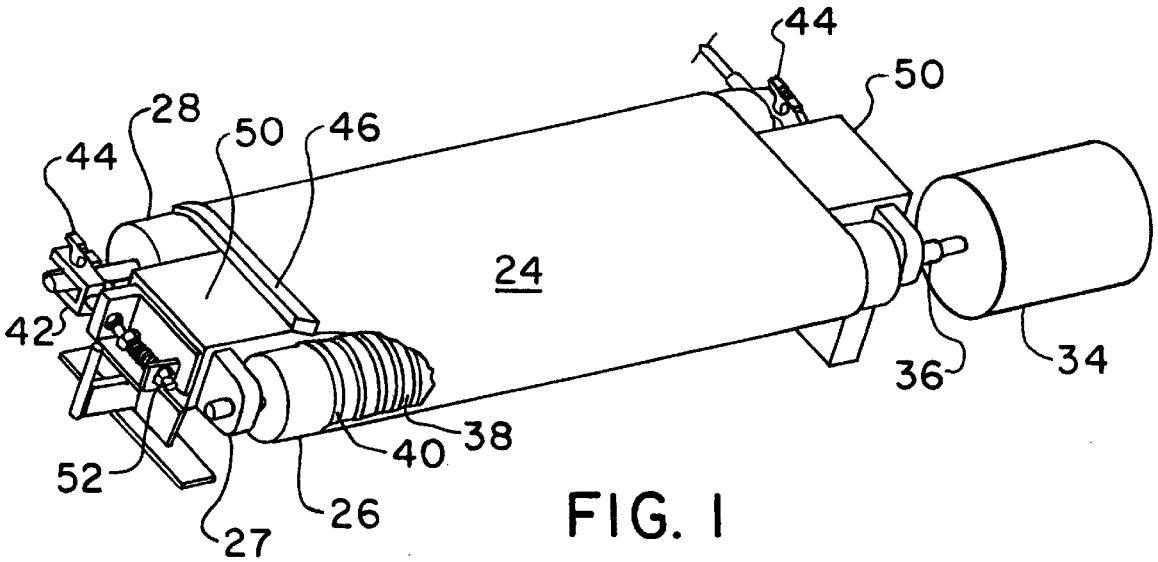
FIG. 1 is a perspective view of a magnetic separator employing a first embodiment of the belt tracking system of the present invention.
Figure 2:
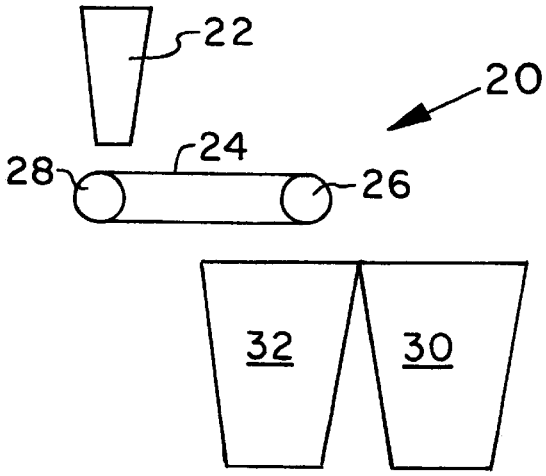
FIG. 2 is a schematic side view of a magnetic separator.

A magnetic separator employing the belt tracking system of the present invention is shown in FIGS. 1 and 2 generally at 20. Separator 20 includes a supply chute 22, a conveyor belt 24 which encircles head roller 26 and tail roller 28, and two material receptacles 30 and 32. Head roller 26 is mounted in bearing assembly 27 and driven by motor 34 through linkage 36. Head roller 26 is comprised of a series of high strength magnetic disks 38 made of rare earth materials interspersed with disk shaped pole pieces 40 which are made of a material which easily magnetized. In use of the separator 20, material 60 which potentially contains magnetic particles 62 is supplied through chute 22 to belt 24. Non-magnetic materials 60 are projected by the inertia imparted to the particles by belt 24 into receptacle 30 (which may be a chute which transfers these particles to a second conveyor belt not shown). Magnetic particles 62 are held in contact with belt 24 as it rounds head roller 26 and a combination of the inertia imparted by belt 24 and the magnetic force from the field surrounding roller 26, impel the magnetic particles into bin 32.

Conveyor belt 24 has a thickness in the range of 2 to 20 mils, more preferably in the range of between 6 and 10 mils. While belts this thin are preferred so as not to reduce the force exerted by the magnetic field of roller 26, such paper thin belts are difficult to track being easily upset by lopsided loads. Rollers 26 and 28 are mounted on cantilever support arm 50. Tail roller 28 is adjustably mounted by means of C-shaped support finger 42. Tension adjustment screw 52 adjusts the position of roller 28 and locking pin 44 secures roller 28 in support finger 42. Locking pin 44 permits rapid removal of tail roller 28 to permit installation of a replacement belt 24.

Figure 3A:
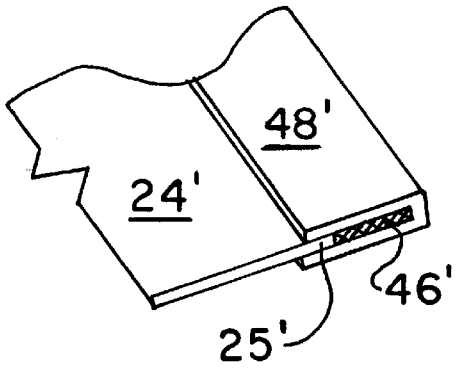
FIG. 3A is a perspective view of a second embodiment of the present invention.
Figure 3B:
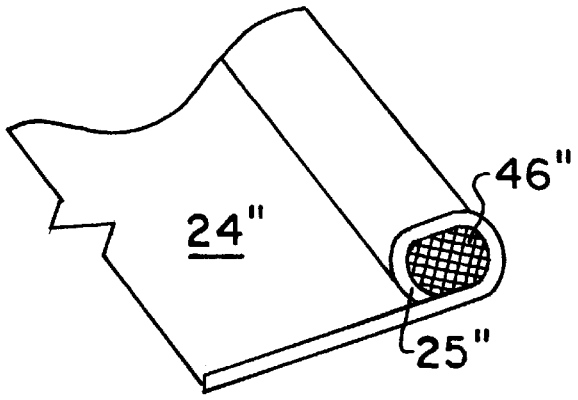
FIG. 3B is a perspective view of a third embodiment of the present invention.
Figure 3C:
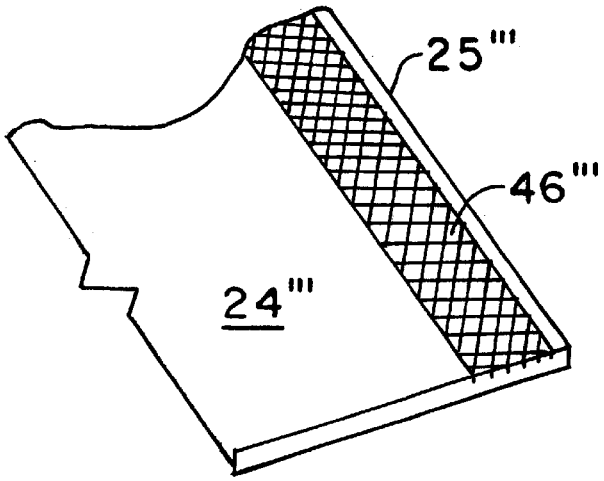
FIG. 3C is a perspective view of a fourth embodiment of the present invention.

Belt 24 has a strip of flexible easily magnetized material 46 attached to at least one of its edges. This strip of material 46 can be adhered to the upper or lower surface of belt 24 or, as shown in FIG. 3A, the easily magnetized material 46' can be encased in an elastomer 48' such as urethane. The elastomer 48' may entirely encase the magnetizable material 46' or only partially surround it. The elastomer 48' may sandwich the edge 25' of conveyor belt 24' as shown in FIG. 3A or may be adhered to either the upper or lower surface of belt 24'. In another embodiment, material 46" is incorporated into an edge portion 25" of the belt 24" by wrapping the edge around the material 46" and adhering the belt to itself (FIG. 3B). In this embodiment, easily magnetizable material takes the form of a steel cable 46". In yet a third embodiment (FIG. 3C), the magnetizable material 46''' is a woven wire mesh which is incorporated into the edge portion 25''' of belt 24''' by vulcanizing the elastomeric belt to assimilate the wire mesh 46'''.

In each instance, the easily magnetized material 46 comes under the influence of the magnetic field produced by head roller 26. The field strength is great adjacent the endmost magnetic disks 38 and the belt 24 is caused to track properly in its revolutions around head (26) and tail (28) rollers. Even should belt 24 be subjected to the destabilizing effects of an unbalanced load, the continuous application of the force exerted by the magnetic field on the material 46 causes the belt 24 to be re-centered and to track properly. As the belt becomes worn (which occurs less often than belts employing crowned rollers or physical belt features engaged by the rollers for tracking), a new belt 24 can be quickly installed by removal of locking pins 44 to permit tail roller 28 to be removed from the worn belt 24 and inserted into a new one. Relatively minor adjustments are typically necessary and are easily made by rotating screws 52 to tension the tail roller 28. The tracking provided by the magnetizable material 46 does not accelerate wear of the belt, as some tracking methods do and is so reliable that less periodic checking is necessary reducing manpower needed to assure proper performance.

Various changes, alternatives and modifications will become apparent to one of ordinary skill in the art following a reading of the foregoing specification. For example, it will be appreciated that the strip need not be continuous but could rather be intermittent. In addition, strips intermediate those positioned along the edges may be provided across the width of the belt, if desired, to provide increased force to influence belt tracking. It is intended that any such changes, alternatives and modifications as fall within the scope of the appended claims be considered part of the present invention.

We claim:

1. A tracking system for a conveyor belt comprising a) at least one strip of flexible magnetizable material connected to at least one of two edge portions of said conveyor belt;

b) a generally cylindrical magnetic roller positioned adjacent at least one end of said conveyor belt producing a magnetic field which affects said strip of flexible magnetizable material keeping said belt tracking properly over said at least one magnetic roller.

2. The tracking system of claim 1 wherein said at least one strip of flexible magnetizable material is adhered to an underneath surface of said conveyor belt adjacent said first edge portion.

3. The tracking system of claim 1 wherein said at least one strip of flexible magnetizable material is embedded in an underneath surface of said conveyor belt adjacent said first edge portion.

4. The tracking system of claim 1 wherein said at least one strip of flexible magnetic material comprises two such strips, one each of said strips being adhered to an underneath surface of said conveyor belt adjacent each of said two edge portions.

5. The tracking system of claim 1 wherein said at least one strip of flexible magnetizable material comprises two such strips, one each of said strips being embedded in a lower surface of said conveyor belt adjacent each of said two edge portions.

6. The tracking system of claim 1 wherein said at least one strip of flexible material is continuous.

7. The tracking system of claim 1 wherein said conveyor belt has a thickness between 2 and 20 mils and is used with a magnetic separator roller.

8. The tracking system of claim 7 wherein said magnetic separator roller includes high strength, rare-earth magnets.

9. The tracking system of claim 8 wherein said magnetic separator roller is comprised of a first stack of rare-earth magnets interposed with a second stack of soft magnetic pole pieces.

10. In a separator employing a magnetic roll to remove magnetic material from non-magnetic material, the separator including a support conveyor belt for receiving material, a tracking system for said conveyor belt comprising at least one flexible strip of magnetizable material positioned adjacent at least one of two edge portions, said at least one flexible strip of magnetizable material being subject to a magnetic field created by the magnetic roll separator to provide proper tracking of said conveyor belt as it transits about said magnetic roll.

11. The tracking system of claim 10 wherein said at least one flexible strip of magnetizable material comprises a continuous strip of material.

12. The tracking system of claim 10 wherein said magnetic roller comprises a first stack of metallic rare-earth plates interdigitated with a second stack of soft magnetic separator plates.

13. The tracking system of claim 10 wherein said at least one flexible strip of magnetizable material is adhered to a nether surface of said conveyor belt adjacent a first edge portion thereof.

14. The tracking system of claim 10 wherein said at least one flexible strip of magnetizable material is embedded in a nether surface of said conveyor belt adjacent at least a first edge portion of said conveyor belt.

15. The tracking system of claim 10 wherein said at least one strip of flexible magnetizable material comprises two such strips, one each of said strips being adhered to a nether surface of said conveyor belt adjacent each of said two edge portions.

16. The tracking system of claim 10 wherein said at least one strip of flexible magnetizable material comprises two such strips, one each of said strips being embedded in a nether surface of said conveyor belt adjacent each of said two edge portions.

17. The tracking system of claim 10 wherein said at least one flexible strip of magnetizable material is adhered to an upper surface of said conveyor belt adjacent a first edge portion thereof.

18. The tracking system of claim 10 wherein said at least one flexible strip of magnetizable material is embedded in an upper surface of said conveyor belt adjacent at least a first edge portion of said conveyor belt.

19. The tracking system of claim 10 wherein said at least one strip of flexible magnetizable material comprises two such strips, one each of said strips being adhered to an upper surface of said conveyor belt adjacent each of said two edge portions.

20. The tracking system of claim 10 wherein said at least one strip of flexible magnetizable material comprises two such strips, one each of said strips being embedded in an upper surface of said conveyor belt adjacent each of said two edge portions.

* * * * *